United States Patent [19]

Gühne et al.

[11] Patent Number: 4,989,295

[45] Date of Patent: Feb. 5, 1991

[54] TELESCOPIC GUIDE WAND FOR FLOOR-CLEANING APPLIANCES

[75] Inventors: Wieland Gühne, Remscheid; Peter Hannemann; Hans-Joachim Birr, both of Wuppertal; Jürgen Jäger, Witten, all of Fed. Rep. of Germany

[73] Assignee: Vorwerk & Co. Interholding GmbH, Wuppertal, Fed. Rep. of Germany

[21] Appl. No.: 520,019

[22] Filed: May 7, 1990

[30] Foreign Application Priority Data

May 5, 1989 [DE] Fed. Rep. of Germany ..... 3914840

[51] Int. Cl.[5] ..... A47L 9/32

[52] U.S. Cl. ..... 15/410; 15/144 B

[58] Field of Search ..... 15/410, 144 B

[56] References Cited

U.S. PATENT DOCUMENTS

| | | | |
|---|---|---|---|
| 1,575,028 | 3/1926 | Bates | 15/410 |
| 1,918,519 | 7/1933 | Clements | 15/410 X |
| 2,607,863 | 8/1952 | MacFarland | 15/410 X |
| 2,660,457 | 11/1953 | Mallon | 15/410 X |
| 4,319,380 | 3/1982 | Simm et al. | 15/144 B X |

*Primary Examiner*—Chris K. Moore

*Attorney, Agent, or Firm*—Walter Ottesen

[57] ABSTRACT

The invention is directed to a telescopic guide wand for floor-cleaning apparatus such as household vacuum cleaners. The guide wand includes two concentrically arranged tubes which telescopically engage each other and conjointly define an inner space to accommodate the electrical supply cable for the motor blower head of the vacuum cleaner. The tubes are latched with respect to each other in several steps and the supply cable extends as helically configured cable within the upper portion of the wand. The supply cord extends concentrically out of the end of the upper tube which is configured as a handle and can be connected to the house electrical supply system. The end of the guide wand facing toward the apparatus has a connecting device disposed thereon. On its upper member, the guide wand has the following: a stowing cavity for the cable lined with insulating material; a guide sleeve minimizing the telescoped overall length of the wand which supports, when the wand is in its extended position, the portion facing the motor; and, an end stop to prevent separation of the upper and lower members.

4 Claims, 3 Drawing Sheets

TELESCOPIC GUIDE WAND FOR FLOOR-CLEANING APPLIANCES

FIELD OF THE INVENTION

This invention relates to a telescopic guide wand for floor-cleaning appliances such as household vacuum cleaners. The guide wand includes two concentrically arranged tubes which telescopically engage each other and conjointly define an inner space for accommodating the power supply cable for the motor blower head of the vacuum cleaner. The tubes are latched with respect to each other in several steps and the power supply extends via a helically configured cable within the upper portion of the wand. The supply cord extends concentrically out of the end of the upper tube which is configured as a handle and can be connected to the house electrical supply system. The end of the guide wand facing toward the appliance has a connecting device arranged thereon.

BACKGROUND OF THE INVENTION

Such guide wands for floor-cleaning appliances are known and disclosed, for example, in U.S. Pat. No. 2,607,863. This patent discloses a vacuum cleaner having a telescopic guide wand defining a hollow internal space through which a helical cable extends for supplying power to the motor blower unit. The telescopic guide wand defines a longitudinal axis and is realized with two tubes telescopically insertable into each other so as to be mutually displaceable along this axis. The tubes are held in a fixed position with respect to each other by a clamp which is tightened with a screw connection.

A disadvantage of such solutions is that the cable is completely jammed into itself during each telescoping operation or pushed out of the upper wand end forming the handle with the telescopic length of the wand being only reduced to one half and control for possible defects cannot be observed. Another disadvantage is a lack of rigidity at the location of the wand where clamping takes place when the wand is fully telescoped. This is especially the case for guide wands made of plastic.

SUMMARY OF THE INVENTION

It is an object of the invention to avoid the above disadvantages by providing a guide wand for floor-cleaning appliances wherein the overall length in its retracted position can be kept very small while maintaining mechanical strength and electrical safety with possible assembling errors being immediately visible from outside.

An advantage of the invention is that the guide wand presents both high rigidity in its telescopically extended condition and minimum overall length in its retracted condition while taking into account all electrical and mechanical safety measures for the user.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
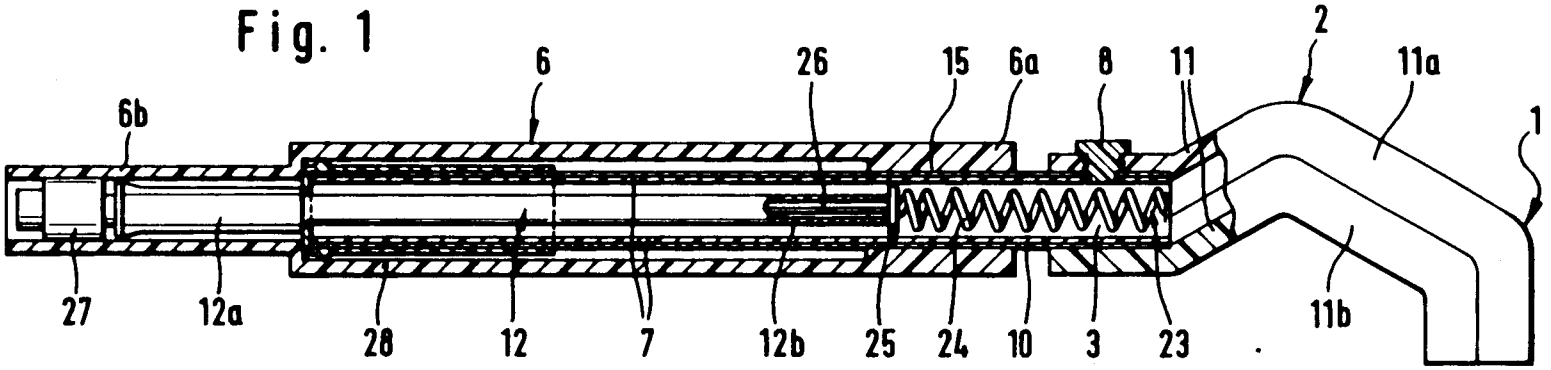
FIG. 1 is a side elevation view, partially in section, of a guide wand according to the invention with the guide wand telescopically collapsed.

Referring to FIG. 1, the guide wand 1 includes a handle-end unit 2 and a motor-end unit 6 with the handle-end unit 2 being arranged in an axially telescoping manner in relation to the motor-end unit 6. The handle-end unit 2 includes two handle half shells (11*a*, 11*b*) which conjointly define the handle per se.

The motor-end unit 6 accommodates the handle-end unit 2 therein as shown. The handle-end unit 2 is provided with a metal sleeve 10 which is mounted in the two plastic handle half shells (11*a*, 11*b*). The plastic half shells (11*a*, 11*b*) simultaneously constitute the insulating material for the cable stowing cavity 3. These plastic half shells (11*a*, 11*b*) are fixedly joined to and maintained in position by the metal sleeve 10 by means of a form fit and threaded fasteners 8 of which one is shown, so that metal sleeve 10 and the half shells (11*a*, 11*b*) conjointly define the handle-end unit 2.

The cable stowing cavity is disposed within metal sleeve 10 and is lined with insulating material 7. The cable 23 has a helically formed cable portion 24 which is disposed within the stowing cavity 3 of the handle-end unit 2. As the handle-end unit 2 is displaced into the motor-end unit 6, to telescopically collapse the guide wand, the cable is stacked in an orderly fashion in its stowing cavity 3 by an end plate 25 which is formed as an integral portion of the cable guide member 12.

The cable guide member 12 has a left-hand segment 12*a* and a right-hand segment 12*b* which terminates in the end plate 25. The cable guide member 12 accommodates and guides the non-helically formed portion 26 of the cable 23. At its other end, the left-hand segment 12*a* of the cable guide member 12 carries an outlet receptacle 27 (FIGS. 1 and 3) which is somewhat mobile in the axial direction and establishes the electrical connection to the motor head (not shown) of the floor-cleaning appliance.

In the event that the cable should become defective, electrical safety is provided in the supporting zone 15 by the slide 28 for accommodating a sliding guide sleeve 4 in that the defective cable (24 or 26) is always held at a safe distance of more than 100 mm from the metal sleeve 10. In addition, assembly or repair errors such as a missing plastic shell 11 are indicated by a simultaneous omission of a handle half shell (11*a* or 11*b*).

Figure 2:
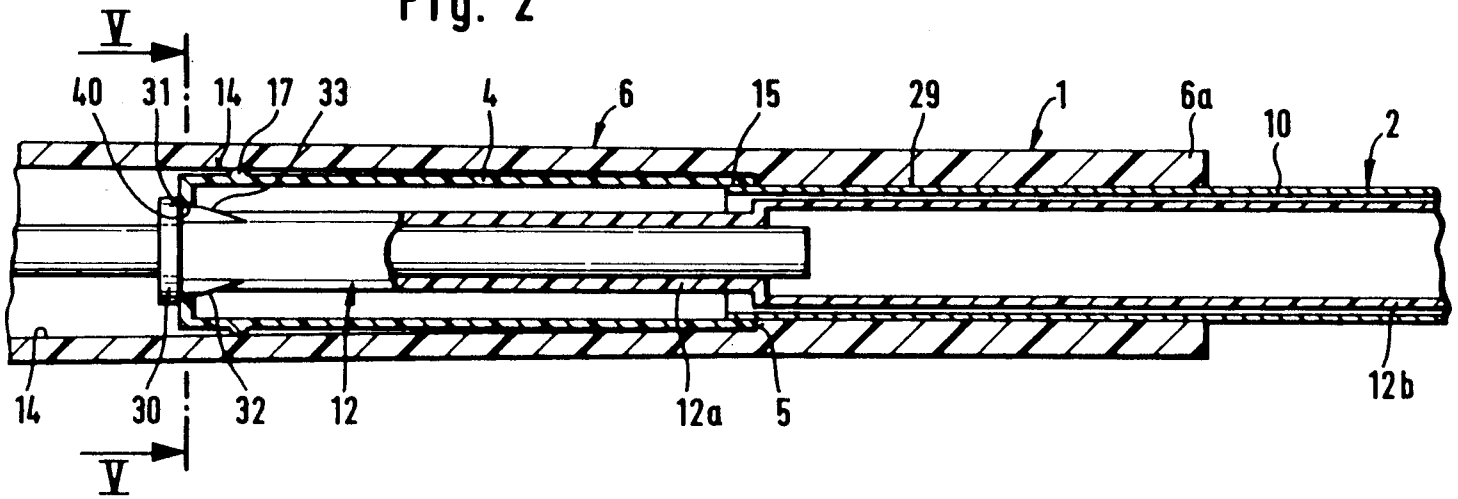
FIG. 2 is a side elevation view, in section, of a portion of the guide wand of FIG. 1 showing the respective positions of the tubes for the condition wherein the wand is fully telescopically extended.
Figure 3:
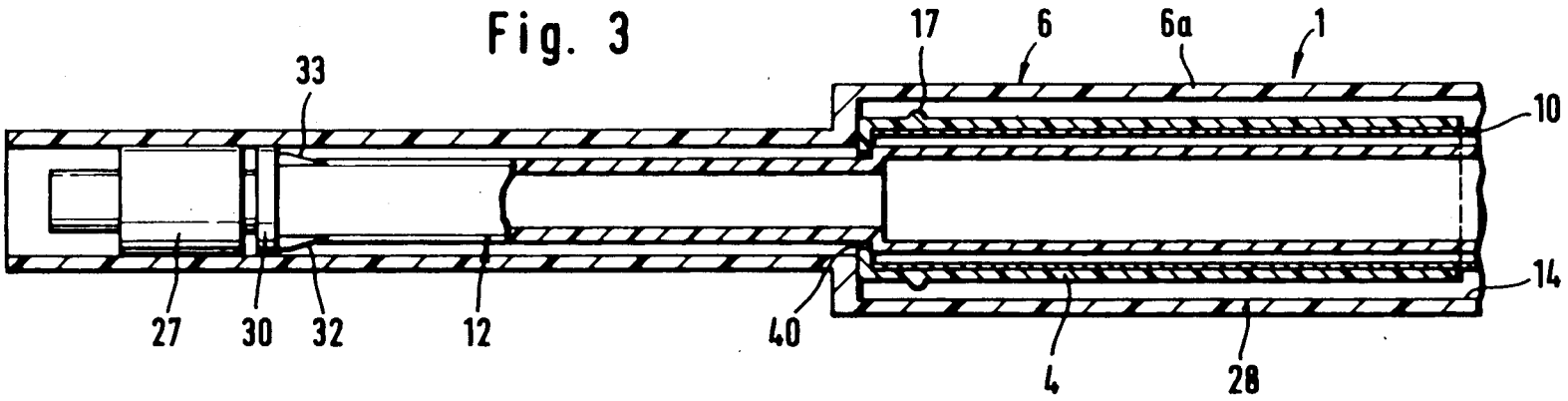
FIG. 3 is a side elevation view, in section, of a portion of the guide wand of FIG. 1 showing the respective positions of the tubes for the condition wherein the wand is fully telescopically collapsed.

Referring to FIGS. 2 and 3, the guide sleeve 4 is provided to locate the wand units (2, 6) in a precise fit free of play and simultaneously minimizes the overall length of the guide wand 1. For this purpose, a guide 29 of predetermined length is formed in the right-hand portion 6*a* of the motor-end unit 6 while the axially movable guide sleeve 4 is arranged in the supporting zone 15.

Figure 4:
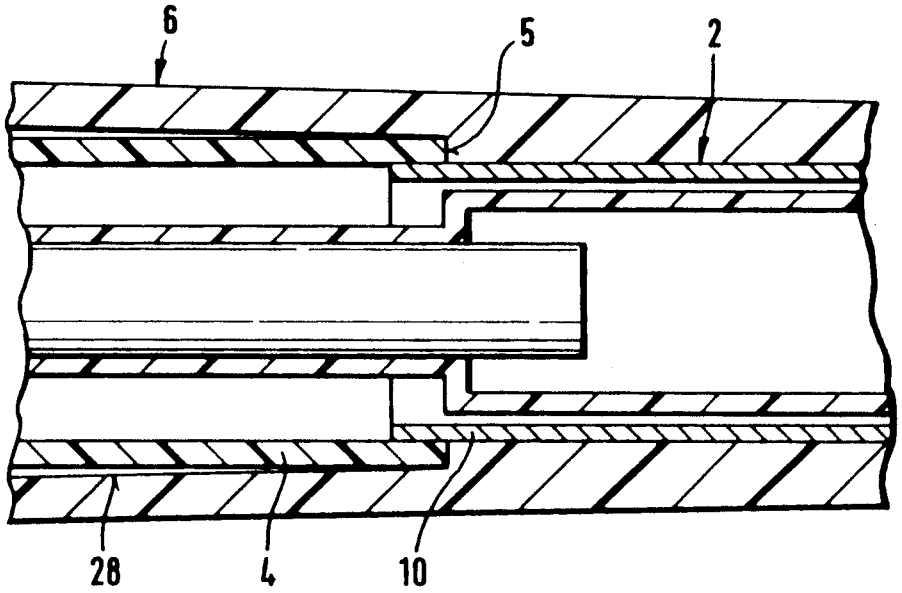
FIG. 4 is an enlarged view of a portion of the guide wand showing a detail view of the stop with the guide wand in its telescopically extended condition; and, FIG. 5 is an enlarged section view taken along line V—V of FIG. 2 showing the guide sleeve held against the inner wall surface of the motor end unit for the condition wherein the guide wand is telescopically extended.

The guide sleeve 4 is adapted at its outer peripheral surface to the inner wall surface 14 of the right-hand portion 6*a* of the motor-end unit 6. For this purpose, protrusion means 17 are provided on the outer peripheral surface of the guide sleeve 4 for contact engaging the inner wall surface 14 when the guide wand is in its telescopically extended condition (FIGS. 2 and 4). The guide sleeve 4 is maintained in a central position in the slide 28 by the metal sleeve 10 of the handle-end unit 2 and the left-hand part 12*a* of guide member 12 which extends axially into the motor-end unit 6. The guide 29 and the supporting region 31 conjointly define the extended supporting zone 15.

Figure 5:
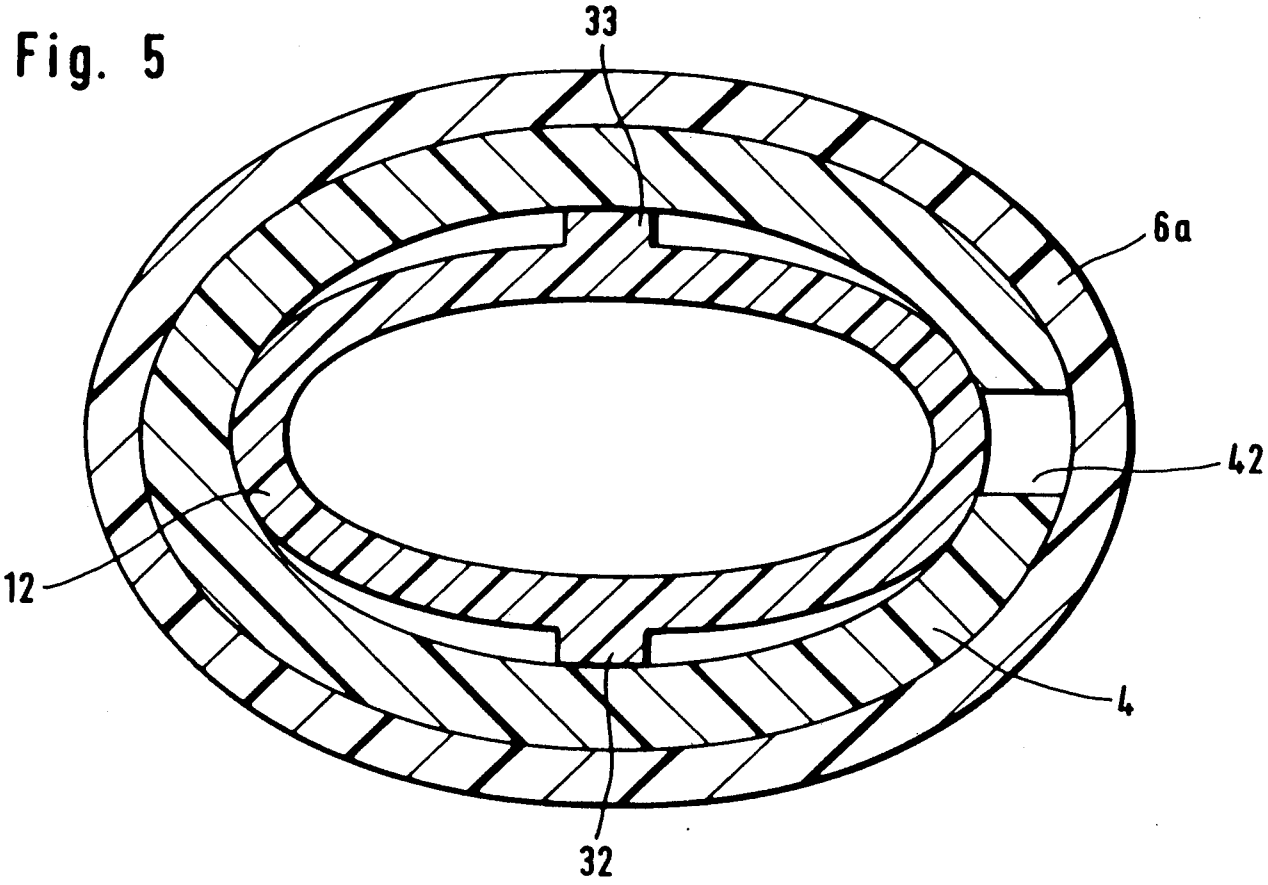

The plastic guide sleeve 4 has slit 42 (FIG. 5) along its longitudinal length so that when ramps (32, 33) enter the gap 40, the guide sleeve 4 is spread radially outwardly by the wedging action of the ramps causing the protrusion means 17 to press against the inner wall surface 14 defining the slide 28 thereby clamping the wand units (2, 6) to each other for the telescopically extended condition of the guide wand shown in FIG. 2. When extending the guide wand, the flange 30 provided on the left-hand end of guide member 12 contact engages the guide sleeve 4 at supporting region 31 of flange 30 and moves the same to the right and the ramps (32, 33) then spread guide sleeve 4 laterally as described above.

When the guide sleeve 4 is moved to the right, it comes into contact engagement with the end stop 5 shown in FIGS. 2 and 4. The supporting region 31 of the flange 30 in combination with end stop 5 prevents the stepped sleeve 12 from being pulled farther to the right and so prevents the handle-end unit 2 from being separated from motor-end unit 6.

The guide sleeve 4 is held against the inner wall surface 14 of the motor-end unit 6 by the ramps (32, 33) when the guide wand is extended. On the other hand, as units (2 and 6) telescope into each other for collapsing the guide wand 1, the handle-end unit 2 slides into the guide sleeve 4 and the narrower left-hand portion 12*a* slides into the motor-end unit 6 as shown in FIG. 1.

It is understood that the foregoing description is that of the preferred embodiments of the invention and that various changes and modifications may be made thereto without departing from the spirit and scope of the invention as defined in the appended claims.

What is claimed is:

1. A guide wand for floor-cleaning apparatus having an electric motor such as a vacuum cleaner, the guide wand comprising:

an elongated upper member including a handle and an electric cable extending through said handle;

an upper tube connected to said handle and defining a cable stowing cavity for accommodating and stacking a first segment of said cable;

an elongated lower member including a lower tube for telescopically receiving said upper tube therein so as to permit said upper tube to be drawn upwardly to cause said tubes to be in a telescopically extended position and to be telescopically collapsed to be in a telescopically collapsed position;

said tubes being concentric and defining a common longitudinal axis;

electrical connecting means mounted in said lower tube for connecting to the electric motor of the apparatus; and, said cable having a lower end connected to said electrical connecting means;

a cable guide disposed in said lower tube for holding a second segment of said cable, said cable guide being connected to said upper tube so as to move therewith as said upper tube is moved relative to said lower tube between said positions;

a guide sleeve mounted in said lower tube concentric with said cable guide and so as to be movable along said axis;

stop means formed in said lower tube to limit the movement of said guide sleeve and prevent said upper tube from being pulled out of said lower tube;

catch means formed on said cable guide for catching said guide sleeve as said upper tube is drawn upwardly thereby moving said guide sleeve into abutting engagement with said stop means; and, bracing means for bracing said guide sleeve between said tubes when said tubes are in said telescopically extended position.

2. The guide wand of claim 1, said handle and said upper tube comprising two plastic half shells conjointly defining a grip portion and a tubular portion; a metal tube lined with insulating material and being disposed in said tubular portion; and, said cable stowing cavity being formed in said metal tube.

3. The guide wand of claim 1, said lower tube having an inner wall surface and said cable guide having an outer wall surface; and, said guide sleeve being disposed between said surfaces.

4. The guide wand of claim 3, said guide sleeve having slit means formed therein to permit said guide sleeve to expand outwardly in response to a radial force applied to said guide sleeve and directed radially from said axis; and, said bracing means including ramp means for engaging said guide sleeve so as to apply said radial force to said guide sleeve to press the same against said inner wall surface when said guide sleeve reaches said stop means; and, said slit means and said ramp means conjointly defining said bracing means.

* * * * *